US005503099A

United States Patent [19]

Peterson

[11] Patent Number: 5,503,099

[45] Date of Patent: Apr. 2, 1996

[54] TOWABLE WATER RECREATION DEVICE

[75] Inventor: LeRoy L. Peterson, Omaha, Nebr.

[73] Assignee: Sportsstuff Inc., Omaha, Nebr.

[21] Appl. No.: 442,519

[22] Filed: May 16, 1995

[51] Int. Cl.[6] ..... B63B 21/04

[52] U.S. Cl. ..... 114/253; 441/66; 441/131

[58] Field of Search ..... 114/253, 254, 114/345, 343; 441/40, 35, 65, 66, 67, 129, 130, 131, 132

[56] References Cited

U.S. PATENT DOCUMENTS

| | | | |
|---|---|---|---|
| 933,331 | 9/1909 | Niedringhaus | 114/253 |
| 2,871,491 | 2/1959 | Van Vorst | 441/66 |
| 3,455,571 | 7/1969 | Dallera et al. | 441/66 |
| 3,664,290 | 5/1972 | Finn | 441/66 |
| 4,302,003 | 11/1981 | Hughes | 441/66 |
| 5,006,087 | 4/1991 | Peterson | 441/66 |
| 5,304,082 | 4/1994 | Wolfe | 441/131 |
| 5,360,360 | 11/1994 | Peterson | 441/130 |

*Primary Examiner*—Stephen Avila
*Attorney, Agent, or Firm*—Henderson & Sturm

[57] ABSTRACT

An inflatable, towable water recreation device comprising a generally U-shaped rear passenger area with a forward tubular housing for additional passengers. The overall shape of the device is cylindrical with a centrally positioned towing strap, thus permitting the device to complete 360 degree rolls during towing. Handholds are provided both on the exterior and interior of the device for passenger securement and safety during maneuvering as well as for use while entering and exiting the device. A durable, rip resistant synthetic fabric encloses the entire structure to protect it from external damage and to facilitate towing.

18 Claims, 4 Drawing Sheets

TOWABLE WATER RECREATION DEVICE

TECHNICAL FIELD

This invention relates to water recreational devices, and more particularly to an inflatable device which may be towed behind a motor boat.

BACKGROUND ART

Water recreational devices for towing behind motor boats include a vast array of structures and designs, from a simple automobile inner tube to such sophisticated devices as an "Inflatable Towable Chariot" disclosed in U.S. Pat. No. 5,360,360. While the more advanced designs offer greater enjoyment and protection from wind and water, they are quite limited in their maneuverability, designed as they are to remain in a substantially upright position as they skim across the surface of the water.

DISCLOSURE OF THE INVENTION

The inflatable, towable water recreation device of the present invention comprises a generally U-shaped rear passenger area with a forward tubular housing providing additional passenger space as well as protection for the passengers' upper bodies. The overall shape of the device is cylindrical with a centrally positioned towing strap, thus permitting the device to complete 360 degree rolls during towing. Handholds are provided both on the exterior and interior of the device for passenger securement and safety during maneuvering as well as for use while entering and exiting the device. A durable, rip resistant synthetic fabric encloses the entire structure to protect it from external damage and to facilitate towing.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
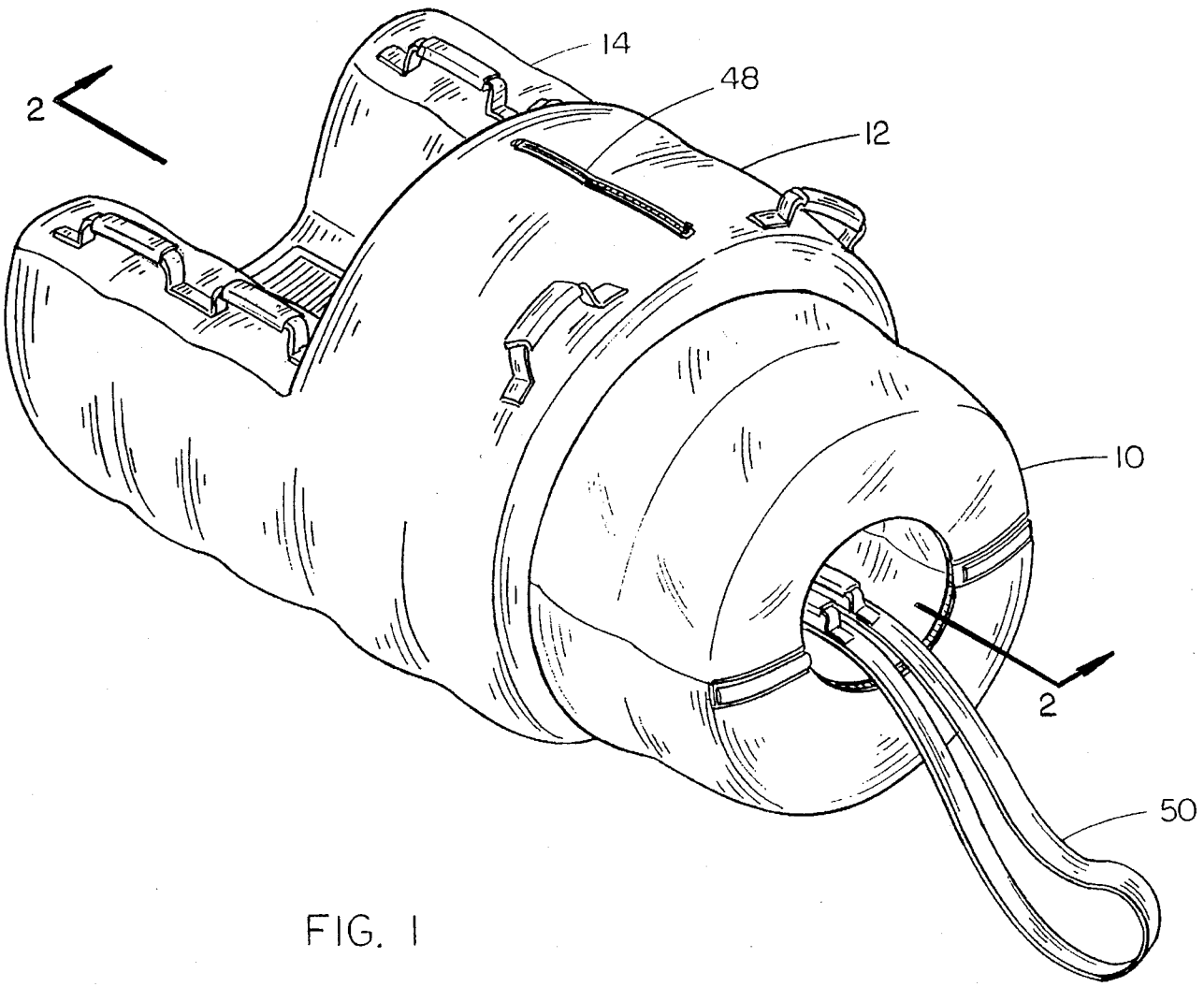
FIG. 1 is a perspective view of a preferred embodiment of the invention.

Referring now to the drawings, wherein like reference numerals designate identical or corresponding parts throughout the several views, a preferred embodiment of the invention is depicted in FIGS. 1 though 5. A perspective view of the invention is depicted in FIG. 1 and can be seen to comprise three sections: a front section 10, a center section 12, and a rear section 14.

Figure 2:
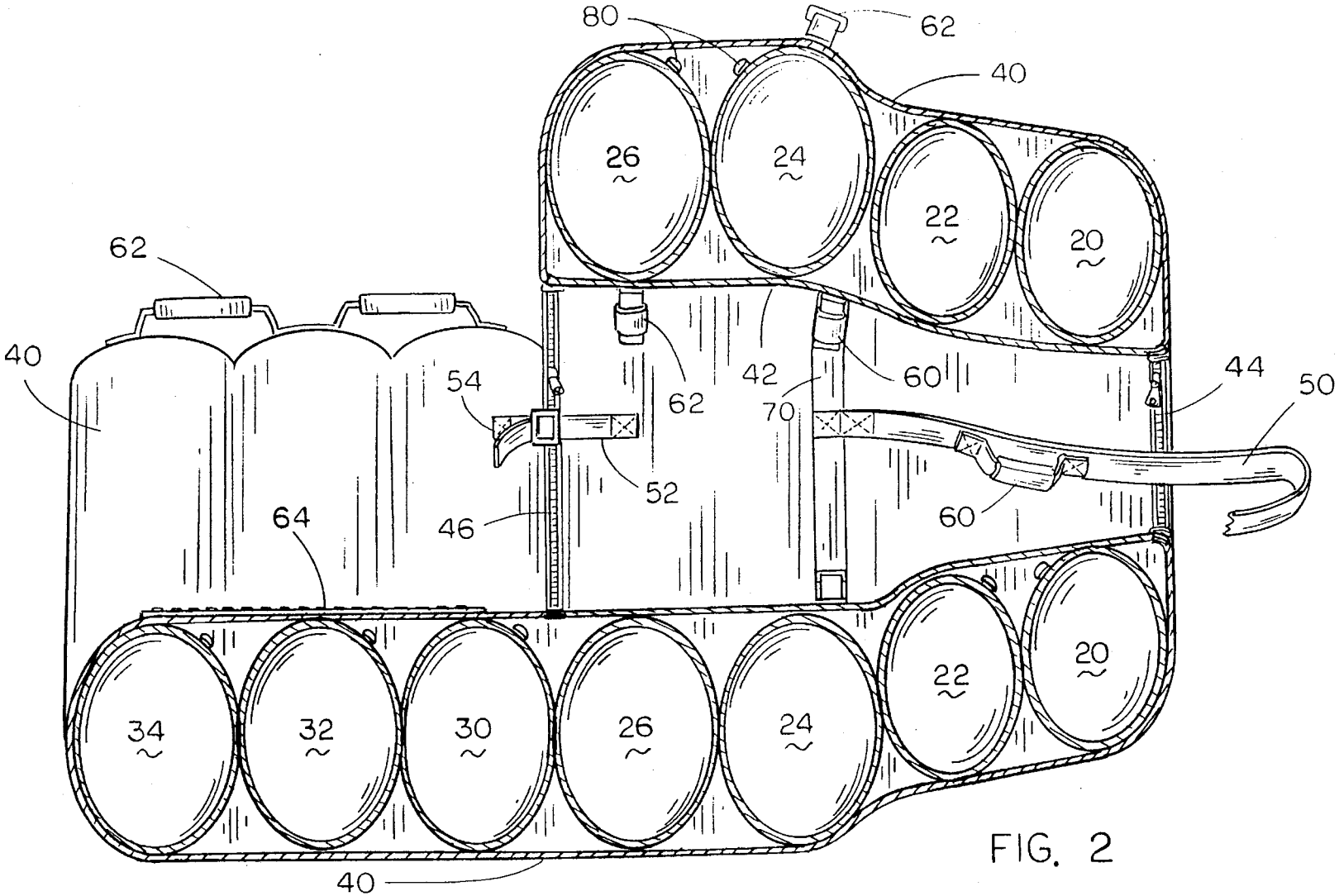
FIG. 2 is a sectional view taken along line 2—2 of FIG. 1.
Figure 3:
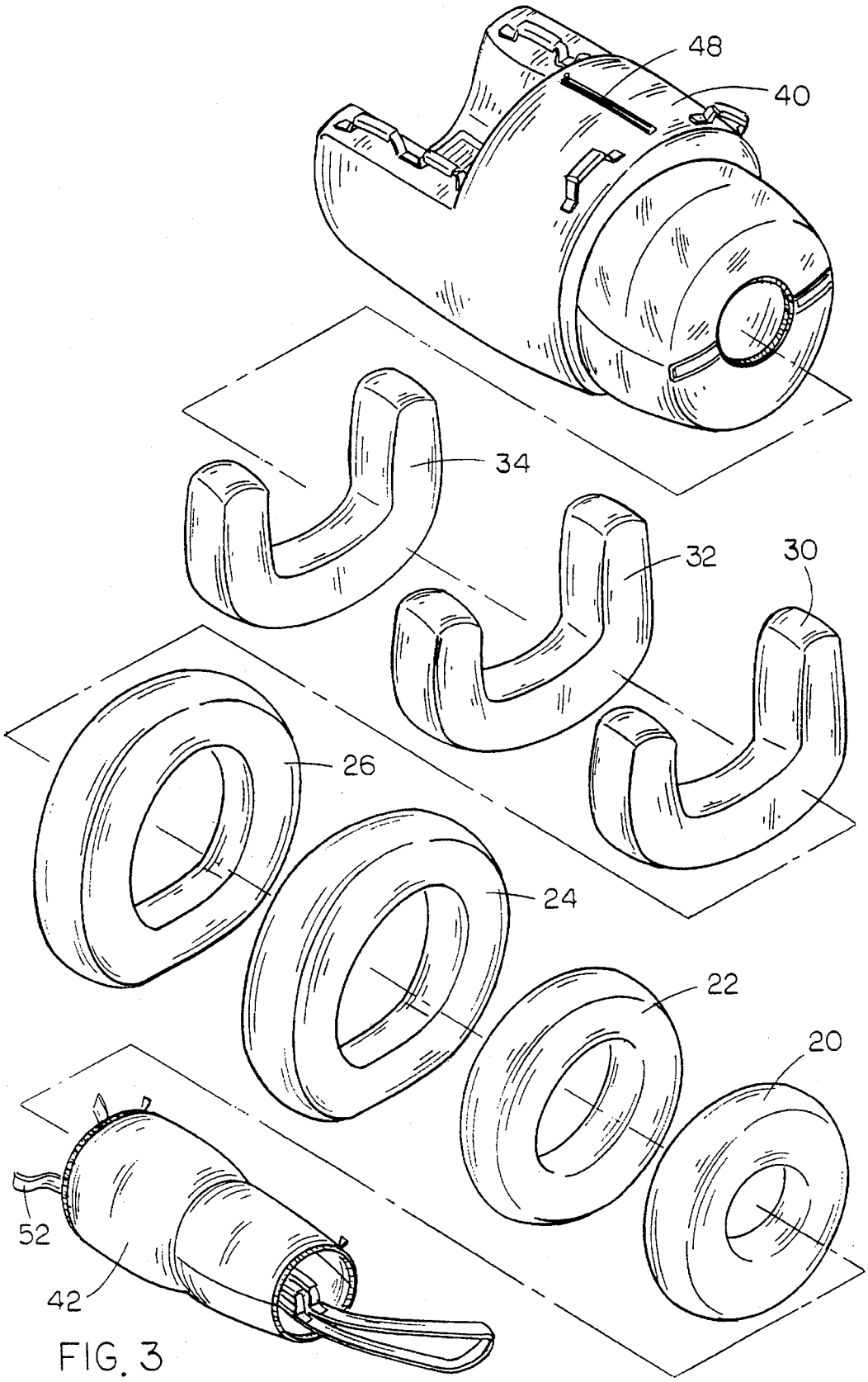
FIG. 3 is an exploded view of the invention.
Figure 4:
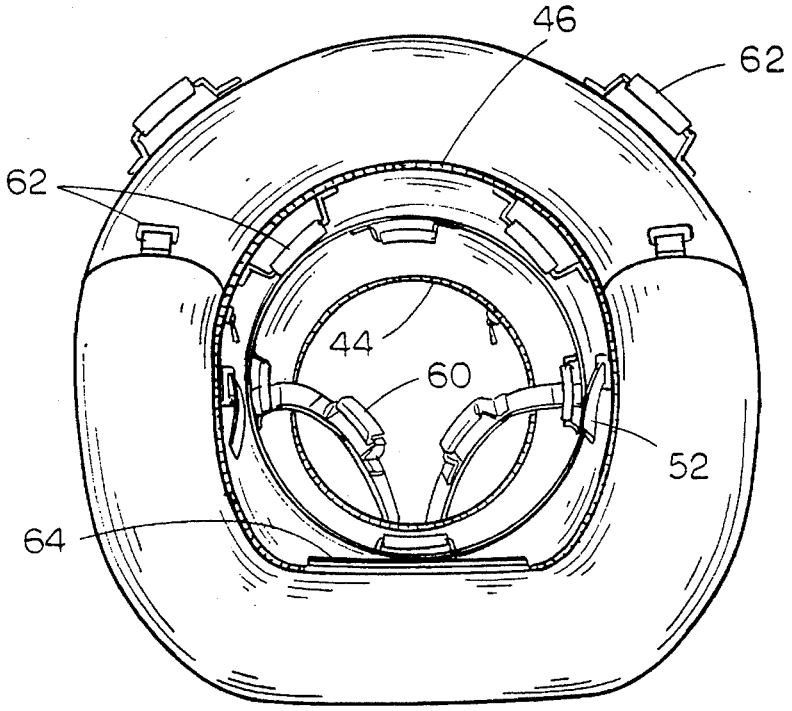
FIG. 4 is a rear elevational view of the invention.

Referring to FIGS. 2 and 3, it can be seen that the front, tubular section 10 is comprised of two inflatable ring-shaped bladders 20, 22. Forward bladder 20 is the smaller of the two, having an outside diameter of approximately 36 inches and an inside diameter of approximately 14 inches. Bladder 22 is slightly larger, with an outside diameter of approximately 40 inches and an inside diameter of approximately 16 inches. Bladders 24 and 26 of the center, tubular section are of equal size, with outside diameters of approximately 44 inches and inside diameters of approximately 20 inches. The size differentials of the bladders 20, 22, 24, 26 give the forward end of the device a somewhat conical shape to enable easier towing and better maneuverability. It should also be noted that bladders 24 and 26 are generally flat on the bottom, corresponding to the U-shaped bladders 30, 32, 34 to be described below. This design provides for much greater upright stability of the invention, while still permitting rolling maneuvers.

Three U-shaped inflatable bladders 30, 32, 34 form the structural framework of the rear, main passenger section of the invention, having a vertical height of approximately 28 inches, an outside width of approximately 44 inches and an inside width of approximately 20 inches.

The construction of the various inflatable bladders, ordinarily comprised of thermosealed 20 to 30 gauge sheets of polyvinylchloride, is well known in the art and need not be further described here. It should be noted, however, that in this preferred embodiment of the invention, the front bladders 20, 22 are fabricated from transparent material.

The protective jacket of the invention is comprised of two components, greatly facilitating the insertion and removal of the inflatable bladders enclosed therein. Best seen in FIG. 3, the outer jacket 40 provides a sleeve of protective material for containing the seven inflatable bladders and for holding them in proper relationship to one another. The inner jacket 42 fits within the interior of the four ring-shaped bladders and is then attached by zippers 44, 46 at its forward and rearward ends, respectively, to the outer jacket 40 (FIG. 2). A third zipper 48 is installed on the upper side of the center area of outer jacket 40 to provide access to the inflation valves 80 of the center bladders 24, 26. Access to the remaining bladder inflation valves 80 is provided through forward and rearward zippers 44, 46. The protective jackets 40, 42 are preferably fabricated from puncture resistant, non-stretchable fabric such as 850D nylon. In the preferred embodiment, the fabric of the outer protective jacket covering the upper half of the two front ring bladders 20, 22 is made of a transparent material to provide visibility for passengers riding therein.

The towing system of the invention is comprised of an elongate strap 50 stitched to a circular strap 70 which is in turn sewn to the inside of inner jacket 42 as seen in FIG. 2. This configuration distributes the considerable strain imparted by the towing system over a much broader area. The straps 50, 70 are also fitted with handles 60 for passengers wishing to ride within the forward tubular section. A pair of reinforcement straps 52 are sewn adjacent the rearward end of the inner protective jacket 42 which connect to their respective counterparts 54 on the outer protective jacket 40. These reinforcement straps 52, 54 serve to relieve the strain on the rear zipper 46 during towing operations.

A number of handles 62 are secured to the protective jackets 40, 42 for passenger security and to aid in maneuvering the invention. A mat 64, fabricated from rubber or other appropriate slip-resistant material, is secured within the bottom of the U-shaped section for additional passenger security, safety, and comfort.

Figure 5:
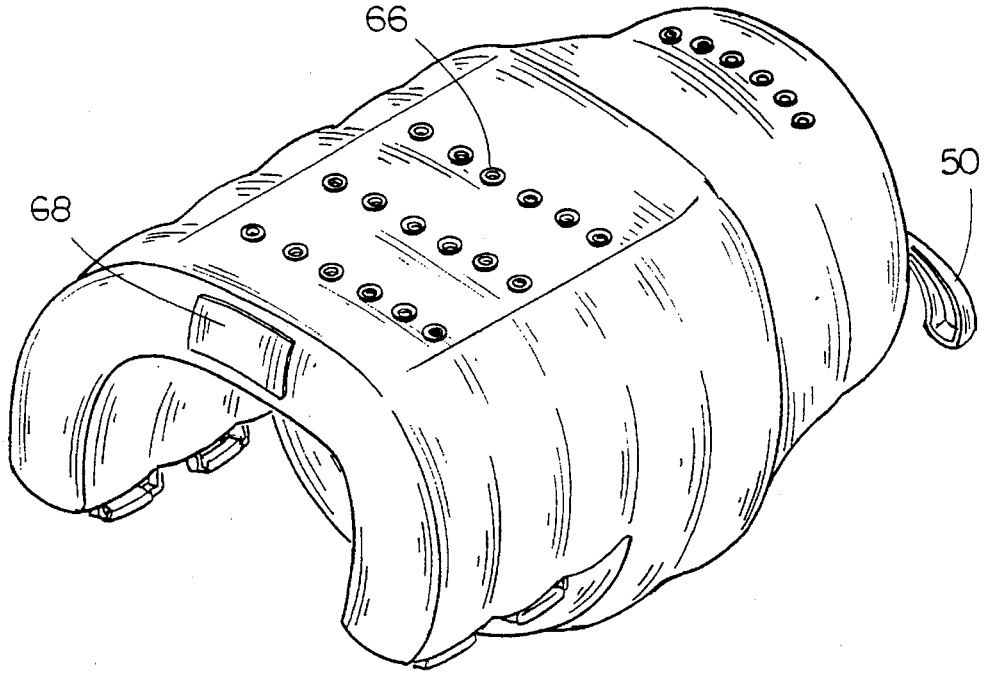
FIG. 5 is a perspective view of the bottom of the invention.

FIG. 5 depicts a series of drain holes 66 in the lower side of the outer protective jacket 40 to permit accumulated water to drain away. A mesh vent 68 is provided in the rear of the outer jacket 40 to permit adequate ventilation, expansion, and contraction.

Obviously, many modifications and variations of the present invention are possible in light of the above teachings. For example, the device could be manufactured utilizing fewer bladders for the several sections, or conceivably with only a single bladder. Such an embodiment would then not necessarily require the cover of the preferred embodiment. It is therefore to be understood that, within the scope of the appended claims, the invention may be practiced otherwise than as specifically described.

What is claimed is:

1. A personal recreation device for towing behind a towing vehicle, comprising:

(a) a forward section including an elongate doughnut shaped compartment having an interior of sufficient size to carry a human being therein; and (b) a rearward section, secured to said forward section, including a U-shaped wall having a lower section and spaced-apart, upwardly extending side sections, said rearward section of sufficient size to carry a human being therein.

2. The device as recited in claim 1 wherein said elongate doughnut shaped compartment comprises a plurality of doughnut shaped bladders.

3. The device as recited in claim 1 wherein said elongate doughnut shaped compartment comprises a front section and a rear section, said front section having a smaller diameter than said rear section.

4. The device as recited in claim 1 wherein said rearward section comprises a plurality of U-shaped bladders.

5. The device as recited in claim 1 wherein said forward section is transparent.

6. The device as recited in claim 1, further comprising a protective jacket covering said forward section and said rearward section.

7. The device as recited in claim 6 wherein said protective jacket further comprises reinforcement straps extending between said forward section and said rearward section.

8. A personal recreation device for towing behind a towing vehicle, comprising:

(a) a forward, elongate doughnut shaped passenger carrying section; and (b) a rearward, U-shaped passenger carrying section secured to said forward section wherein said forward section comprises a plurality of doughnut shaped bladders.

9. The device as recited in claim 8 wherein said forward section comprises a front section and a rear section, said front section having a smaller diameter than said rear section.

10. The device as recited in claim 8 wherein said rearward section comprises a plurality of U-shaped, inflatable bladders.

11. The device as recited in claim 8 wherein said forward section is transparent.

12. The device as recited in claim 8, further comprising a protective jacket covering said forward section and said rearward section.

13. A personal recreation device for towing behind a towing vehicle, comprising:

(a) a forward section including an elongate doughnut-shaped compartment having an interior surface dimensioned to completely surround the upper portion of a users torso;

(b) a rearward section attached to said forward section and including a curved wall portion dimensioned to at least partially surround the lower portion of a users torso, such that the users torso is at least substantially contained within said forward section and said rearward section; and (c) an elongate towing strap operatively secured on both ends to said interior surface of said forward section and having an intermediate portion dimensioned to project through the opening in said forward section and adapted to be operatively connected to said towing vehicle.

14. The invention as recited in claim 13; wherein, said forward section has a generally tapered configuration.

15. The invention as recited in claim 14; wherein, said rearward section has a generally U-shaped configuration.

16. The invention as recited in claim 13; wherein, said forward section is provided with a generally flat bottom portion.

17. The invention as recited in claim 13; wherein, said rearward section is provided with a generally flat bottom portion.

18. The invention as recited in claim 13; wherein, both the forward section and the rearward section are provided with a generally flat bottom portions.

* * * * *